US008152568B2

(12) United States Patent
Wu

(10) Patent No.: US 8,152,568 B2
(45) Date of Patent: Apr. 10, 2012

(54) CABLE ASSEMBLY WITH NEW INTERFACE

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 6 days.

(21) Appl. No.: 12/807,909

(22) Filed: Sep. 15, 2010

(65) Prior Publication Data

US 2011/0065328 A1 Mar. 17, 2011

(30) Foreign Application Priority Data

Sep. 15, 2009 (CN) ..... 2009 1 0306995

(51) Int. Cl.
*H01R 24/00* (2011.01)

(52) U.S. Cl. ... 439/660; 439/76.1; 439/353; 439/607.56

(58) Field of Classification Search ..... 439/660, 439/76.1, 350, 353, 607.55, 607.56, 352
See application file for complete search history.

(56) References Cited

U.S. PATENT DOCUMENTS 6,663,415 B1 12/2003 Wu
7,128,617 B2 * 10/2006 Wang et al. ..... 439/660
7,281,937 B2 10/2007 Reed et al.
7,422,488 B1 * 9/2008 Wu ..... 439/676
7,485,008 B1 * 2/2009 Yi et al. ..... 439/660
7,534,141 B1 * 5/2009 Wu ..... 439/607.01
7,534,143 B1 * 5/2009 Tsao et al. ..... 439/607.41
7,618,293 B2 * 11/2009 Wu ..... 439/660
7,625,243 B2 * 12/2009 Chen et al. ..... 439/660
7,632,155 B1 * 12/2009 Wu ..... 439/660
7,651,379 B1 * 1/2010 Wu ..... 439/660
7,670,191 B2 * 3/2010 Ortega et al. ..... 439/660
7,686,656 B2 * 3/2010 Zheng et al. ..... 439/660
7,736,184 B1 * 6/2010 Wan et al. ..... 439/607.11
7,744,382 B2 * 6/2010 Zheng et al. ..... 439/79
7,806,704 B2 * 10/2010 Miyoshi et al. ..... 439/108
7,837,510 B1 * 11/2010 Hung et al. ..... 439/660
7,841,905 B2 * 11/2010 Zheng et al. ..... 439/660
7,909,653 B1 * 3/2011 Wan et al. ..... 439/660
7,938,659 B1 * 5/2011 Zhu et al. ..... 439/218
7,942,704 B2 * 5/2011 Ko et al. ..... 439/660
7,946,893 B2 * 5/2011 Chen et al. ..... 439/660
7,967,641 B2 * 6/2011 Miyoshi ..... 439/660
7,972,151 B2 * 7/2011 He et al. ..... 439/108
7,972,181 B1 * 7/2011 Zhu et al. ..... 439/660
7,988,460 B1 * 8/2011 Chiu et al. ..... 439/76.1
8,062,073 B1 * 11/2011 Szczesny et al. ..... 439/660

(Continued)

*Primary Examiner* — Ross Gushi
(74) *Attorney, Agent, or Firm* — Wei Te Chung; Andrew C. Cheng; Ming Chieh Chang

(57) ABSTRACT

A cable assembly (100) comprises a case (2) having a receiving room (25); a printed circuit board (3) received into the receiving room; a cable (5) extended into the receiving room and electrically connected with a rear portion of the printed circuit board; and a terminal module (4) disposed in the receiving room and electrically connected with a front portion of the printed circuit board. The terminal module has an insulative housing (411, 421), a set of first signal terminals (412) and a set of second signal terminals (422) disposed in the insulative housing. Each of first and second signal terminal has a mating section (4121, 4221) extending to a top surface of the insulative housing. The mating section (4121) of each first signal terminal is in alignment with the mating section (4221) of each second signal terminal along a front to rear direction.

20 Claims, 14 Drawing Sheets

U.S. PATENT DOCUMENTS

2006/0134983 A1* 6/2006 Wang et al. ..... 439/607
2006/0286865 A1* 12/2006 Chou et al. ..... 439/607
2006/0294272 A1* 12/2006 Chou et al. ..... 710/62
2009/0117784 A1* 5/2009 Wu ..... 439/660
2009/0117785 A1* 5/2009 Wu ..... 439/668
2009/0258539 A1* 10/2009 Zheng et al. ..... 439/607.41
2010/0015831 A1* 1/2010 Miyoshi ..... 439/218
2010/0015855 A1* 1/2010 Chiang ..... 439/660
2010/0022138 A1* 1/2010 Miyoshi et al. ..... 439/660
2010/0055980 A1* 3/2010 Chen et al. ..... 439/607.01
2010/0093222 A1* 4/2010 He et al. ..... 439/638
2010/0159745 A1* 6/2010 Wan et al. ..... 439/607.11
2010/0159751 A1* 6/2010 Chiu et al. ..... 439/660
2010/0173529 A1* 7/2010 He et al. ..... 439/660
2010/0173530 A1* 7/2010 Tsai ..... 439/660
2010/0216340 A1* 8/2010 Lin et al. ..... 439/607.01
2010/0248515 A1* 9/2010 Kondo et al. ..... 439/218
2011/0003514 A1* 1/2011 Nguyen et al. ..... 439/660
2011/0009008 A1* 1/2011 Wang ..... 439/660
2011/0070778 A1* 3/2011 Wan et al. ..... 439/660
2011/0124234 A1* 5/2011 Chung ..... 439/660
2011/0143599 A1* 6/2011 Peng ..... 439/660
2011/0195601 A1* 8/2011 Chen et al. ..... 439/607.01
2011/0269322 A1* 11/2011 He et al. ..... 439/78
2011/0269341 A1* 11/2011 He et al. ..... 439/607.01

* cited by examiner

CABLE ASSEMBLY WITH NEW INTERFACE

FIELD OF THE INVENTION

The present invention relates to a cable assembly, and more particularly to a high speed cable assembly with a new interface for mating with a complementary connector.

DESCRIPTION OF PRIOR ART

PCI Express Association has released an External Cabling Specification Revision 1.0 in January, 2007. The aboved said Specification discloses a high speed cable assembly which is marked as X16 cable assembly. The cable assembly comprises a metallic housing, a pair of PCBs disposed in the housing and a cable electrically connected with the pair of PCBs, the pair of PCBs are arranged paralleled with each other in a vertical direction. The cable assembly further has a latching member and a pulling member assembled on a top surface of the metallic housing, the latching member is connected with the pulling member and actuated by the pulling member.

However, the height of an interface of the cable assembly will be increased due to the setting of the pair of PCBs. Thus, the interface of the cable assembly can not meet the developing trend of low profile. On another aspect, the signal transmitting speed of the cable assembly is required more and more quickly, thus, the conductive pads of the printed circuit board will also be increased. However, when the width of the PCB is determined, the more conductive pads should be formed on the PCB, so the layout of the printed circuit board will be more difficulty.

As discussed above, an improved cable assembly overcoming the shortages of existing technology is needed.

SUMMARY OF THE INVENTION

Accordingly, an object of the present invention is to provide a cable assembly with a new mating face.

In order to achieve the above-mentioned objects, a cable assembly comprises a case having a receiving room; a printed circuit board received into the receiving room; a cable extended into the receiving room and electrically connected with a rear portion of the printed circuit board; and a terminal module disposed in the receiving room and electrically connected with a front portion of the printed circuit board. The terminal module has an insulative housing, a set of first signal terminals and a set of second signal terminals disposed in the insulative housing. Each of first and second signal terminal has a mating section extending to a top surface of the insulative housing. The mating section of each first signal terminal is in alignment with the mating section of each second signal terminal along a front to rear direction.

Other objects, features and advantages of the invention will be apparent from the following detailed description taken in connection with the accompanying drawings.

DETAILED DESCRIPTION OF PREFERRED EMBODIMENTS

Figure 1:
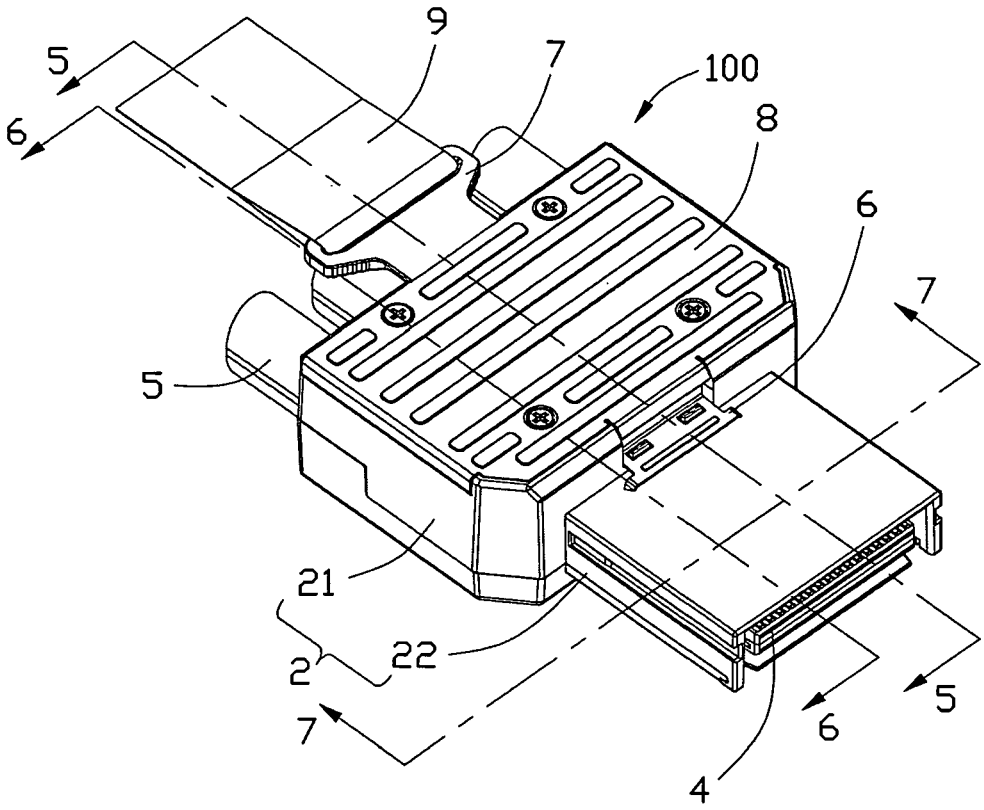
FIG. 1 is a perspective view of a cable assembly in accordance with the present invention.
Figure 2:
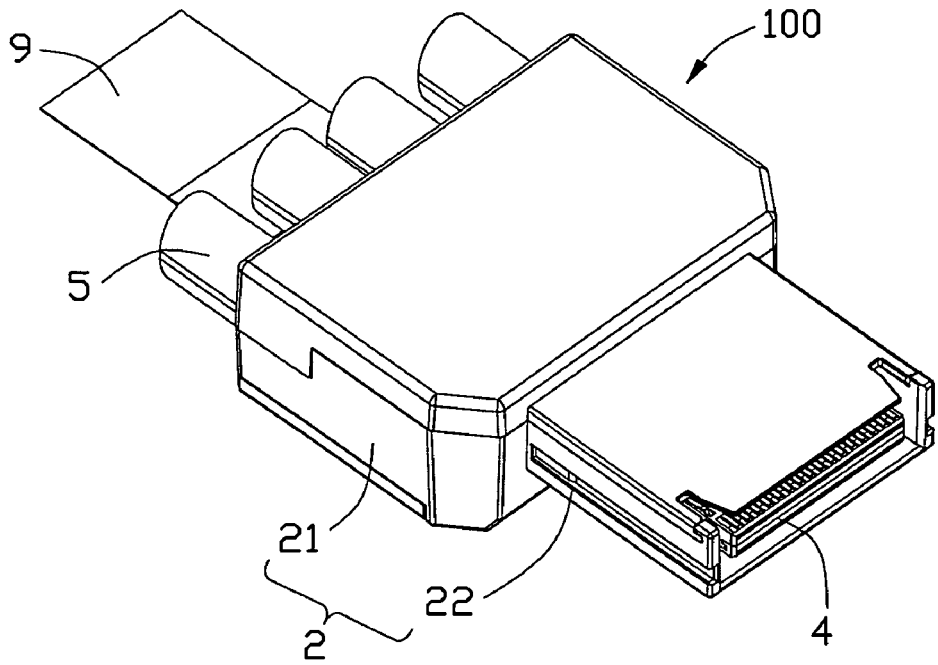
FIG. 2 is another perspective view of the cable assembly of FIG. 1.

Reference will now be made to the drawing figures to describe the present invention in detail.

Please refer to FIGS. 1 to 5 and 13 to 14, a cable assembly 100 made in accordance with the present invention mates with a complementary connector 200. The cable assembly 100 comprises a case 2, a printed circuit board 3 received into the case 2, a terminal module 4 electrically connected with a front end of the printed circuit board 3, a plurality of cables 5 extended into the case 2 and electrically connected with a rear end of the printed circuit board 3. The cable assembly 100 further comprises a latching member 6 and a pulling member 7 assembled to a top surface of the case 2, and a shielding member 8 assembled to the top surface of case 2 and shielding a part of the latching member 6 and the pulling member 7.

Referring to FIGS. 1 to 4 and 6, the case 2 is made of metallic material and comprises a base portion 21 and a mating portion 22 extending forward from the base portion 21. The cross-section size of the mating portion 22 is smaller than that of the base portion 21. The case 2 defines a receiving room 25 extending from a front surface (not figured) to the rear surface (not figured) thereof. The receiving room 25 is used for receiving the printed circuit board 3 and the terminal module 4. The case 2 includes an upper cover 23 and a lower cover 24 engaged with each other. The lower cover 24 defines a plurality of supporting posts 241 formed on a top surface (not figured) of a front section of the lower cover 24. The supporting posts 241 are divided into two rows respectively located at two sides of the top surface (not figured) of the front section of the lower cover 24. At least one supporting post 241 defines a receiving hole 2411. The upper cover 23 defines a plurality of positioning posts 231 corresponding to the supporting posts 241 in an up to down direction. And, at least one positioning post 231 has a free end 2311 which can be received into the corresponding receiving hole 2411 when the upper cover 23 and lower cover 23 assembled together.

Figure 3:
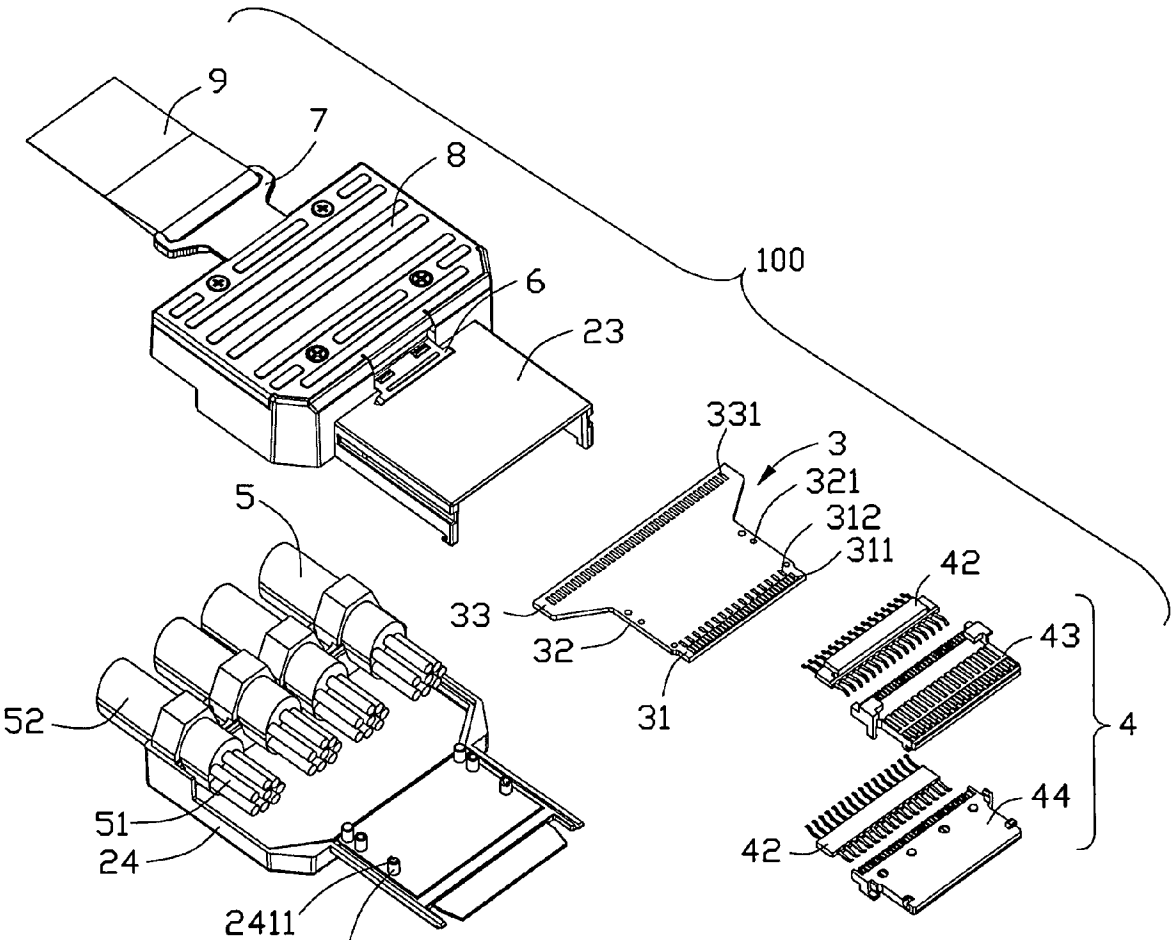
FIG. 3 is an exploded, perspective view of the cable assembly of FIG. 1.
Figure 4:
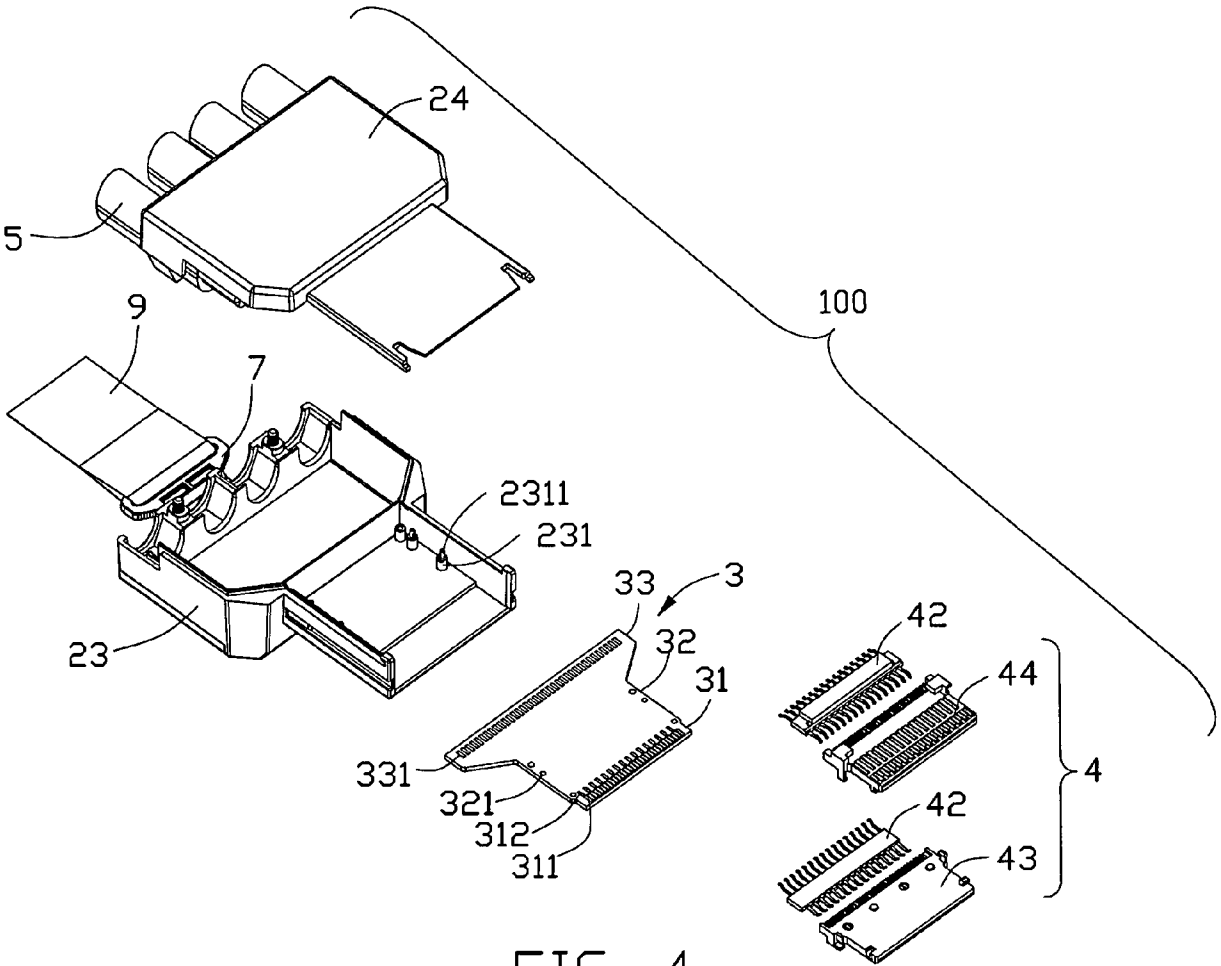
FIG. 4 is an exploded, perspective view of the cable assembly of FIG. 2.

Referring to FIGS. 3 to 4, the printed circuit board 3 has a mating portion 31 at a front section thereof, a terminating portion 33 at a rear section thereof and a connecting portion 32 connected with the mating portion 31 and the terminating portion 33. The mating portion 31 defines a plurality of conductive pads formed on two opposite top and bottom surfaces thereof. The plurality of conductive pads includes a plurality of first and second conductive pads 311, 312. The first conductive pads 311 are disposed in the front of the second conductive pads 312. And the number of the first conductive pads 311 is larger than that of the second conductive pads 312. Each second conductive pad 312 is in alignment with a first conductive pad 311 along a front to rear direction. The connecting portion 32 defines a plurality of through holes 321 which can be cooperated with the corresponding free ends 2311 of the positioning posts 231 of the upper cover 23. The terminating portion 33 defines a plurality of third conductive pads 331 formed on two opposite top and bottom surfaces thereof.

Referring to FIGS. 10 to 11 and 3 to 4, the terminal module 4 includes a first terminal unit 41 and a pair of second terminal units 42 respectively assembled to the top and bottom sides of the first terminal unit 41. Each second terminal unit 42 is formed by a way of insert molding. The first terminal unit 41 has an upper terminal unit 43 and a lower terminal unit 44 assembled together by a way of back to back. And, the upper terminal unit 43 has a same structure with the lower terminal unit 44. The upper terminal unit 43 and the lower terminal unit 44 are also both formed by a way of insert molding.

Referring to FIGS. 8 to 12, the first terminal unit 41 comprises a first insulative housing 411 and an upper and a lower sets of first terminals integrated with the first insulative housing 411. Each set of first terminals include a plurality of first signal terminals 412 and a plurality of grounding terminals 413 which are arranged along a transversal direction and spaced with each other. Each signal terminal 412 of the upper set of first terminals is in alignment with the grounding terminal 413 of the lower set of first terminals in a vertical direction, and each signal terminal 412 of the lower set of first terminals is in alignment with the grounding terminal 413 of the upper set of first terminals in a vertical direction. The first insulative housing 411 defines a plurality of openings arranged along a transversal direction and respectively formed on opposite top and bottom surfaces thereof. The plurality of openings includes a plurality of first openings 4111 and a plurality of second openings 4112 spaced with each other. And, each first opening 4111 has a length longer than that of the second opening 4112. The first insulative housing 411 further defines a plurality of receiving slots 4113 formed on opposite top and bottom surfaces thereof. Each receiving slot 4113 is in alignment with a second opening 4112 in a front to rear direction. In addition, the first insulative housing 411 defines two receiving spaces 4114 respectively formed on two opposite top and bottom surfaces thereof. Each receiving space 4114 is used for receiving a second terminal unit 42.

Referring to FIGS. 3 to 4 and 8 to 9, the upper terminal unit 43 includes an upper insulative base 431 and a plurality of first signal and grounding terminals 412, 413 integrated with the upper insulative base 431. The lower terminal unit 44 includes a lower insulative base 441 and a plurality of first signal and grounding terminals 412, 413 integrated with the lower insulative base 441. The first signal terminals 412 and the grounding terminals 413 formed on the upper and lower insulative base 431, 441 are spaced with each other and arranged along a transversal direction. A plurality of first signal terminals 412 and grounding terminals 413 are together formed to a set of first terminals. The first insulative housing 411 comprises the upper insulative base 431 and the lower insulative base 441 engaged with each other by a way of back to back. The upper insulative base 431 has a same structure with the lower insulative base 441.

Each first signal terminal 412 defines a mating section 4121, a terminating section 4123 and a connecting section 4122 connected with the mating section 4121 and the terminating section 4123. The mating section 4121 of each first signal terminal 412 is received into the second opening 4112 of the first insulative housing 411. The terminating section 4123 of each first signal terminal 412 extends rearward from a rear surface of the first insulative housing 411. The connecting section 4122 of each first signal terminal 412 is disposed in the first insulative housing 411. The grounding terminal 413 has a similar structure with the first signal terminal 412. Each grounding terminal 413 defines a mating section 4131, a terminating section 4133 and a connecting section 4132 connected with the mating section 4131 and the terminating section 4133. The mating section 4131 of each grounding terminal 413 is received into the corresponding first opening 4111 of the first insulative housing 411. The terminating section 4133 of each grounding terminal 413 extends rearward from a rear surface of the first insulative housing 411. The connecting section 4132 of each grounding terminal 413 is disposed in the first insulative housing 411. And, the mating section 4121 of the first signal terminal 412 has a length longer than that of the mating section 4131 of the grounding terminal 413.

Each second terminal unit 42 comprises a second insulative housing 421 and a plurality of second signal terminals 422 integrated with the second insulative housing 421. Each second signal terminal 422 defines an elastic mating section 4221, a terminating section 4223 and a connecting section 4222 connected with the mating section 4221 and the terminating section 4223. The mating section 4221 of each second signal terminal 422 extends forward from a front surface of the second insulative housing 421. The terminating section 4223 of each second signal terminal 422 extends rearward from a rear surface of the second insulative housing 421. The connecting section 4222 is disposed in the second insulative housing 421. The plurality of second signal terminals 422 are arranged along a transversal direction and formed to a set of second terminals.

It should be noted that each first signal terminal 412 is in alignment with a second signal terminal 422 along a front to rear direction when the pair of second terminal units 42 are assembled to the first terminal unit 41. In addition, a first signal terminal 412 and a second signal terminal 412 are formed to a pair of differential signal terminals arranged in a front to rear direction.

Figure 5:
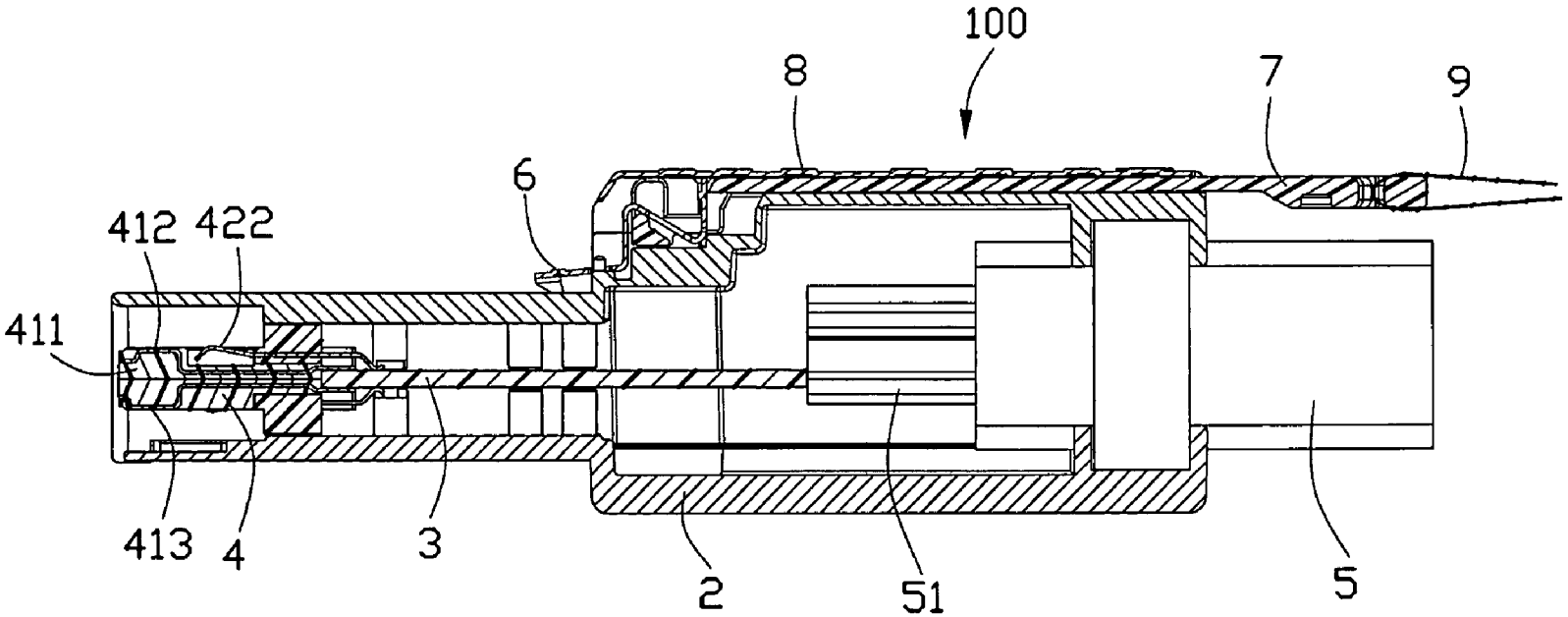
FIG. 5 is a cross section view of the cable assembly of FIG. 1 taken along line 5-5.

Referring to FIGS. 3 to 5, a plurality of cables 5 are terminated to the printed circuit board 3 and extended out of the case 2. Each cable 5 comprises a plurality of conductors 51 and an insulative jacket 52 surrounding the plurality of conductors 51. The plurality of conductors 51 can be electrically connected with the third conductive pads 331 of the terminating portion 33 of the printed circuit board 3.

Referring to FIGS. 3 to 5 and 14, the latching member 6 is assembled to a top surface of the base portion 21 of the metallic case 2. A rear end of the latching member 6 is fixed on the metallic case 2, a front end of the latching member 6 is cantilevered to the rear end of the latching member 6. The pulling member 7 has a front end (not figured) connected with a portion (not figured) of the latching member 6. A tape 9 is attached to a rear end of the pulling member 7. When a rearward pulling force exerts on the pulling member 7 or the tape 9, the front end of the pulling member 7 will actuate the latching member 6 and make the front end of the latching member 6 moving along a down to up direction. When the pulling force is released, the front end of the latching member 6 will be resumed to an original state.

Figure 6:
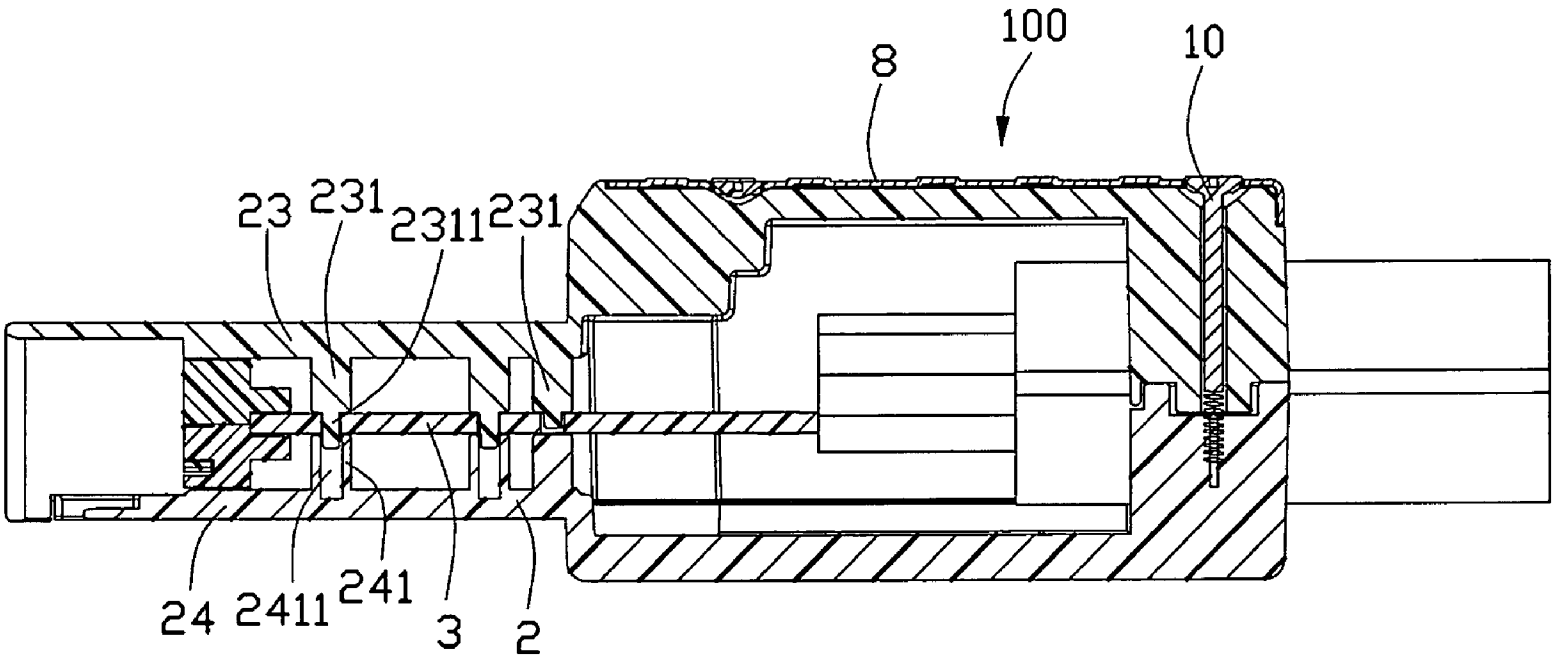
FIG. 6 is a cross section view of the cable assembly of FIG. 1 taken along line 6-6.
Figure 7:
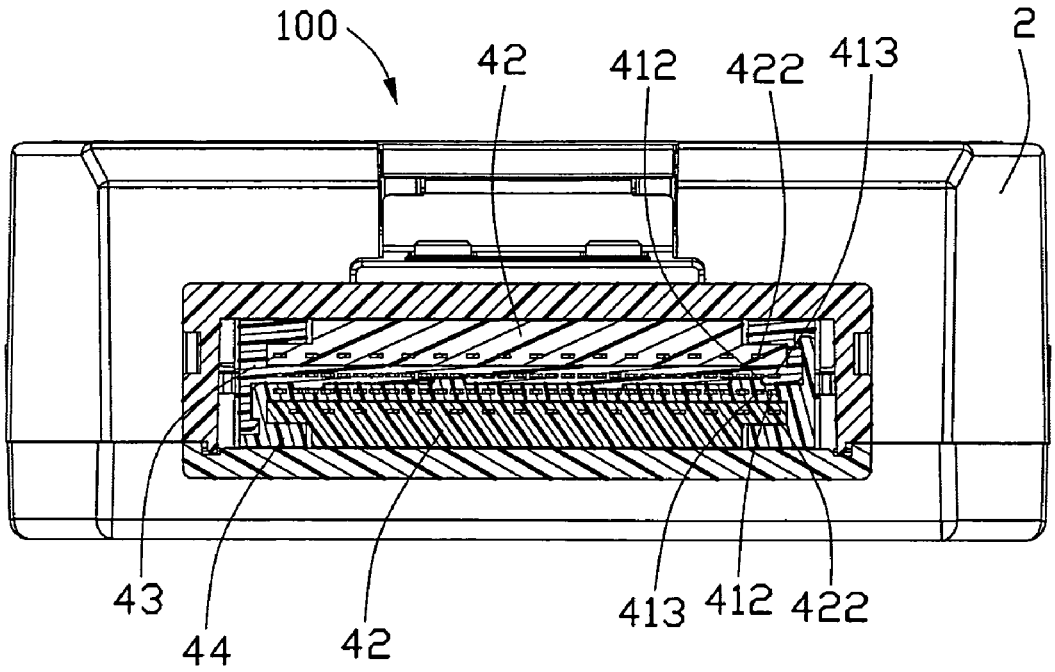
FIG. 7 is a cross section view of the cable assembly of FIG. 1 taken along line 7-7.
Figure 8:
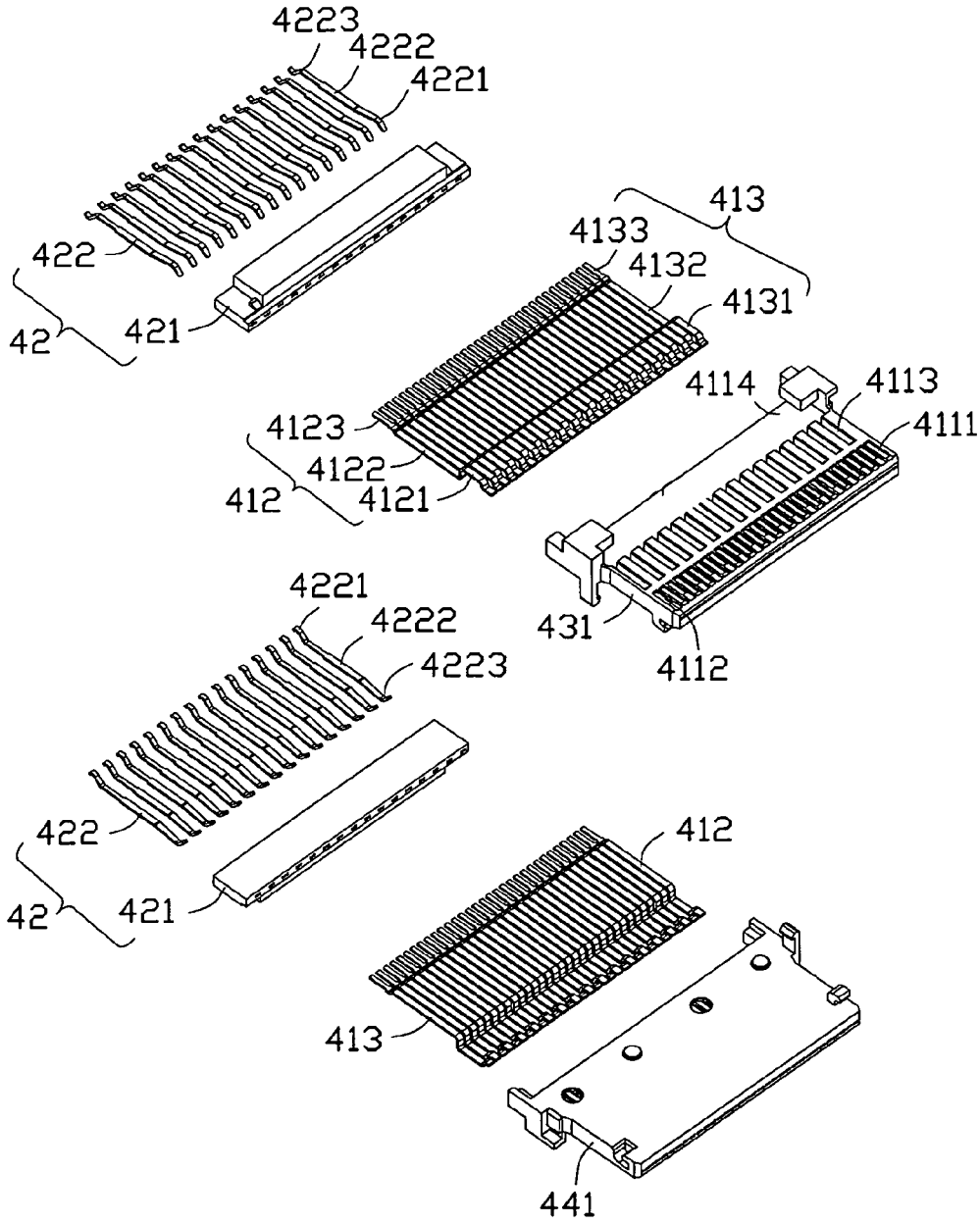
FIG. 8 is an exploded, perspective view of a terminal module shown in FIG. 3.
Figure 9:
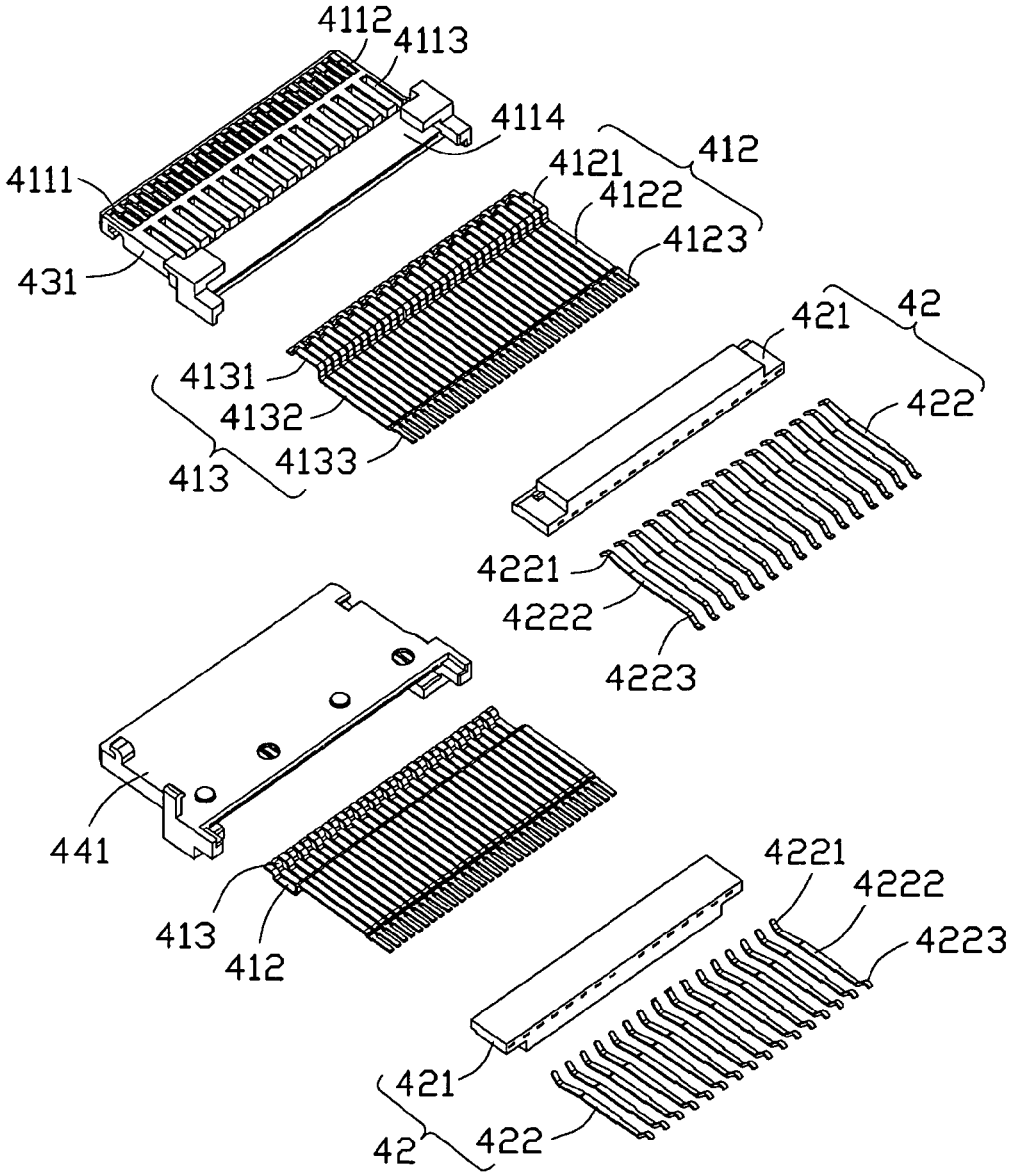
FIG. 9 is another exploded, perspective view of a terminal module of FIG. 8.
Figure 10:
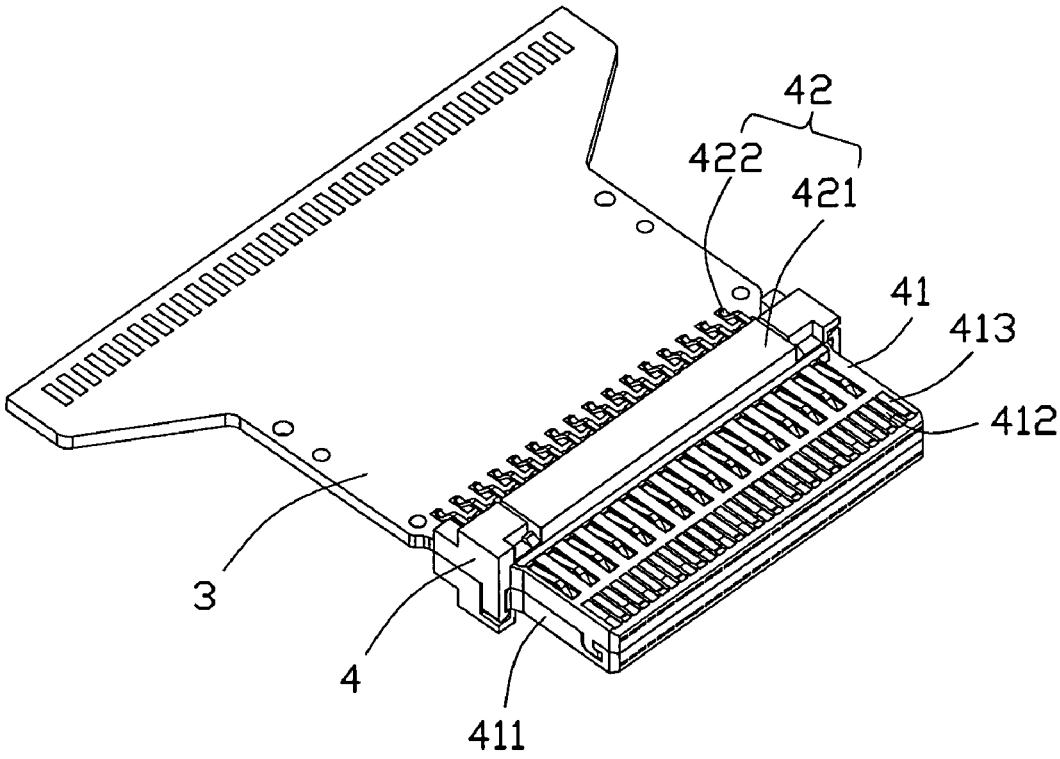
FIG. 10 is a perspective view of an assembled terminal module and printed circuit board of the cable assembly of FIG. 3.
Figure 11:
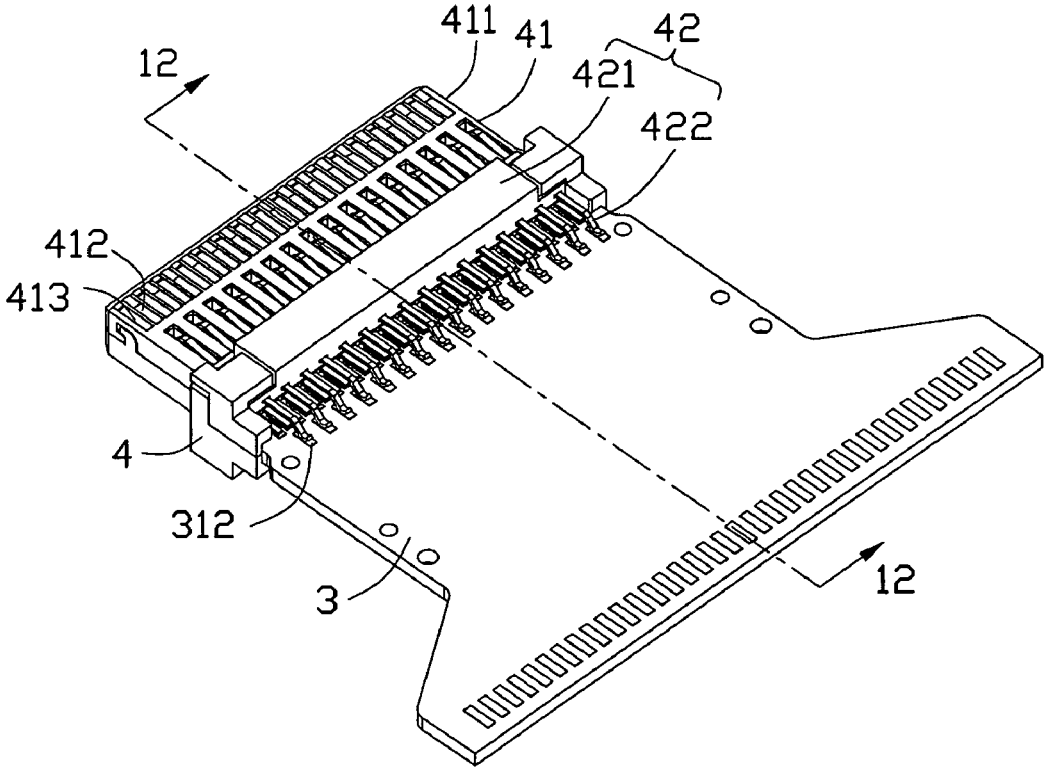
FIG. 11 is another perspective view of an assembled terminal module and printed circuit board of FIG. 10.
Figure 12:
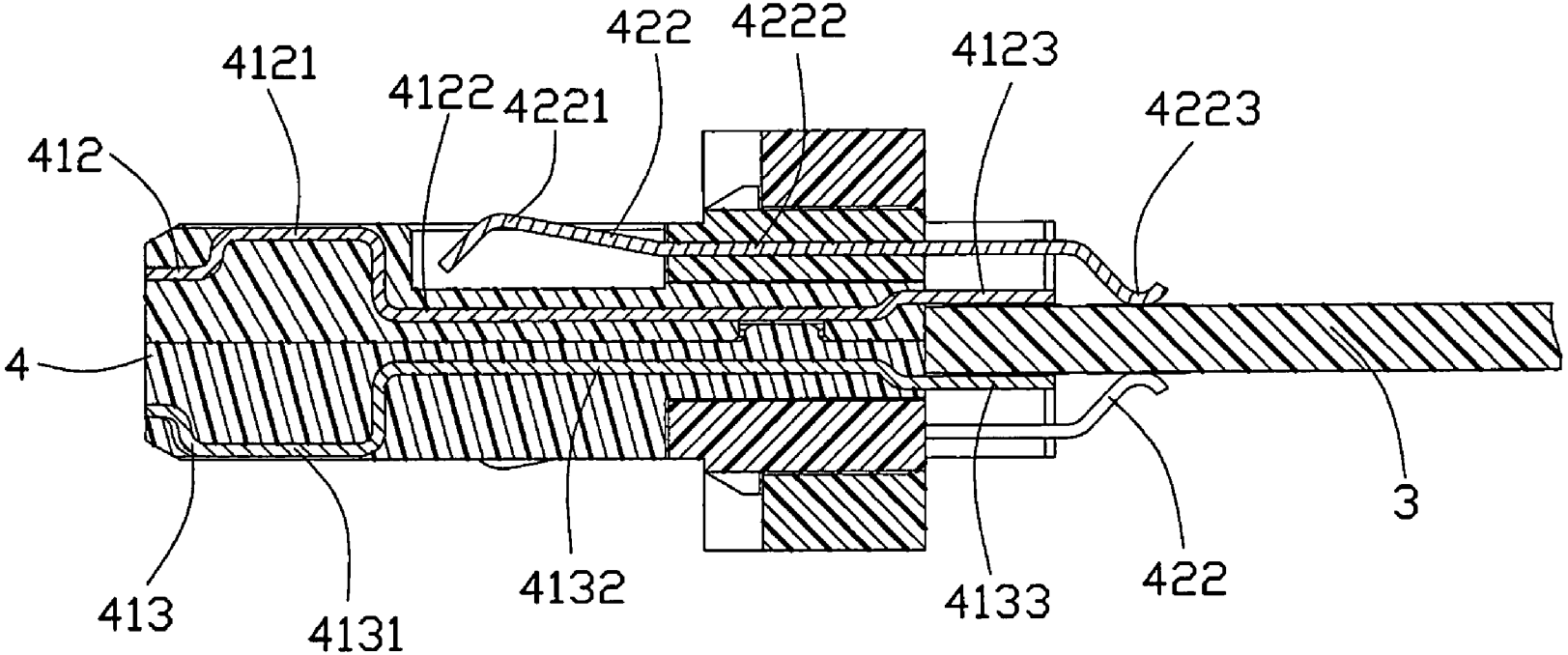
FIG. 12 is a cross section view of the assembled terminal module and the printed circuit board of FIG. 11 taken along line 12-12.

Referring to FIGS. 1 and 6, the shielding member 8 is assembled to a top surface of the base portion 21 of the metallic case 2. Thus, a rear portion of the latching member 6 and a front portion of the pulling member 7 are shielded by the shielding member 8.

Figure 13:
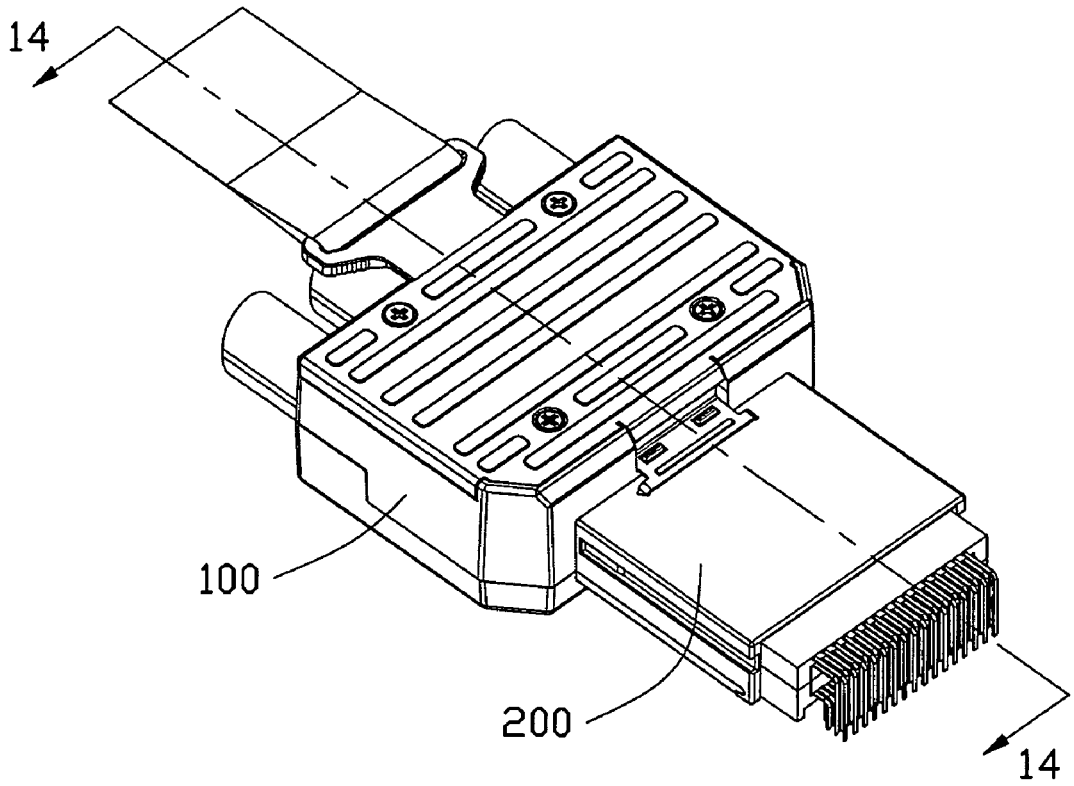
FIG. 13 is a perspective view of the cable assembly mated with the complementary connector.
Figure 14:
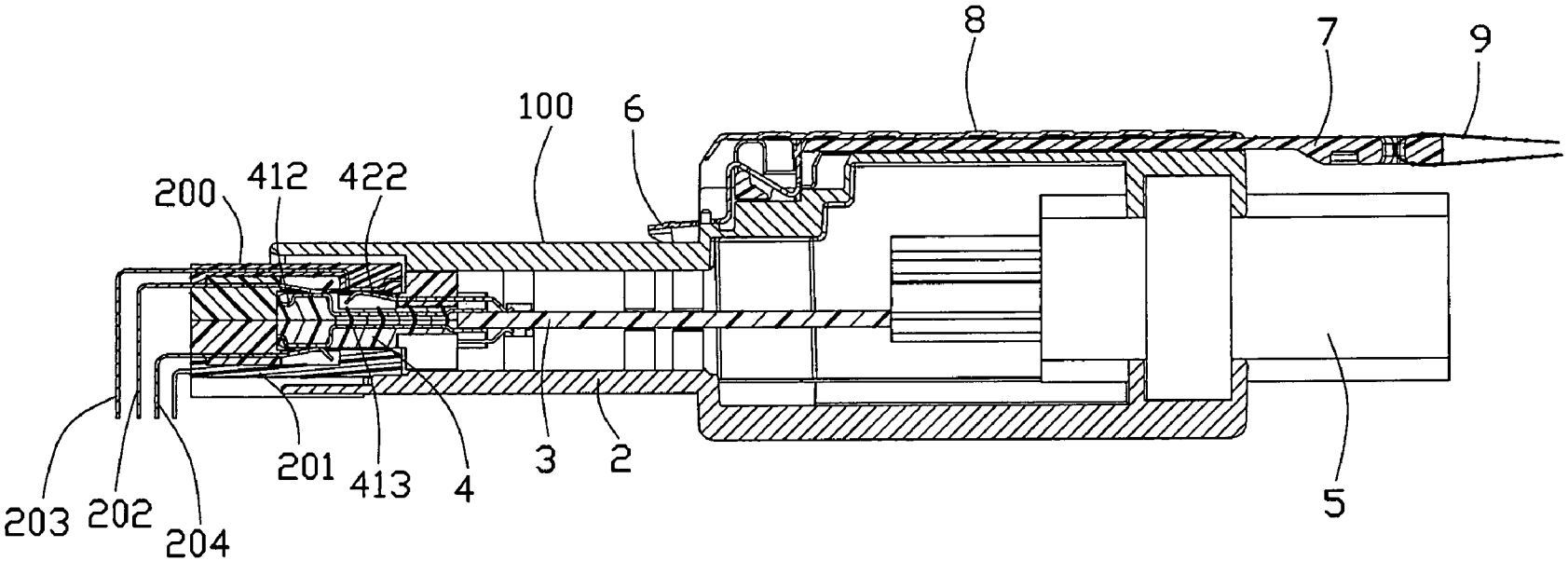
FIG. 14 is a cross section view of the cable assembly mated with the complementary of FIG. 13 taken along line 14-14.

Referring to FIGS. 13 to 14, the complementary connector 200 comprises an insulative box 201, a plurality of first and second signal contacts 202, 203 and grounding contacts 204 disposed in the insulative box 201. The first and second signal contacts 202, 203 are respectively contacted with the first and second terminals 412, 422 of the terminal module 4 when the cable assembly 100 mates with the complementary connector 200. And, at this time, the grounding contact 204 is contated with the grounding terminal 413 of the terminal module 4.

Referring to FIGS. 1 to 14, the assembling process of the cable assembly 100 made in according to the present invention starts from assembling the upper terminal unit 43 and the lower terminal unit 44 together by a way of back to back to form a first terminal unit 41.

After the first terminal unit 41 is formed, then assembling the pair of second terminal units 42 to first terminal unit 41. Each terminal unit 2 is received into each receiving space 4114 of the first terminal unit 41. Thus, each mating section 4221 of the second signal terminal 422 is received into a receiving slot 4113 of the first insulative housing 411. And, a portion of each mating section 4221 extends upward from the top and bottom surfaces of the terminal module 4.

After the pair of second terminal units 42 assembled to the first terminal unit 41, then assembling the printed circuit board 3 to a rear end of the terminal module 4. It should be noted that the terminating sections 4123, 4133 of first signal terminals 412 and the grounding terminals 413 are soldered to the first conductive pads 311 of the printed circuit board 3. And the terminating sections 4223 of the second signal terminals 422 are soldered to the second conductive pads 312 of the printed circuit board 3.

After the printed circuit board 3 is assembled to the terminal module 4, then assembling a plurality of cables 5 to the printed circuit board 3. A plurality of conductors 51 of the cables 5 are soldered to the third conductive pads 331 of the terminating portion 33 of the printed circuit board 3.

After the cables 5 are assembled to the printed circuit board 3, then assembling the terminal module 4, the printed circuit board 3 and the cables 5 to the upper cover 23. The free ends 2311 of the positioning posts 231 of the upper cover 23 pass through the corresponding through holes 321 of the printed circuit board 3. Thus, the printed circuit board 3 is positioned with the upper cover 23.

After the printed circuit board 3, the terminal module 4, the printed circuit board 3 are assembled to upper cover 23, then assembling the lower cover 24 to the upper cover 23. Thus, the free ends 2311 of the positioning posts 231 of the upper cover 23 pass through the printed circuit board 3 and received into the corresponding receiving holes 2411 of the supporting posts 241 of the lower cover 24.

Then, assembling the latching member 6 and the pulling member 7 to the top surface of base portion 21 of the metallic case 2.

Then, assembling the shielding member 8 to the top surface of the base portion 21 of the metallic case 2.

Finally, assembling a plurality of screws 10 to the upper cover 23 and the lower cover 24 along an up to down direction. Thus, the upper cover 23 and the lower cover 24 are engaged with other by the screws 10.

After the above assembling steps, the entire process of assembling of the cable assembly 100 is finished. The cable assembly 100 has a new mating interface with a high speed signal transmitting. And, the new interface of the cable assembly 100 is smaller and lower.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a case having a receiving room;

a printed circuit board received into the receiving room;

a cable extended into the receiving room and electrically connected with a rear portion of the printed circuit board;

a terminal module disposed in the receiving room and electrically connected with a front portion of the printed circuit board, the terminal module having an insulative housing, a set of first signal terminals and a set of second signal terminals disposed in the insulative housing, each of first and second signal terminal having a mating section extending to a top surface of the insulative housing, the mating section of each first signal terminal being in alignment with the mating section of each second signal terminal along a front to rear direction.

2. The cable assembly as recited in claim 1, wherein the terminal module further defines a plurality of grounding terminals disposed in the housing and located in a common plane with the set of first signal terminal, each grounding terminal has a mating section extending to the top surface of the insulative housing, the mating sections of the first signal terminals and the grounding terminals are spaced with each other.

3. The cable assembly as recited in claim 2, wherein the terminal module further defines another set of first signal and grounding terminals, and another set of second signal terminals, each first and second signal terminal has a mating section extending to a bottom surface of the insulative housing, and the mating section of each first signal terminal is in alignment with the mating section of each second signal terminal along a front to rear direction.

4. The cable assembly as recited in claim 3, wherein each grounding terminal has a mating section extending to the top surface of the insulative housing, the mating sections of the first signal terminals and the grounding terminals are spaced with each other.

5. The cable assembly as recited in claim 1, wherein the terminal module comprises a first terminal unit and a second terminal unit assembled to first terminal unit, the first signal terminal is formed on the first terminal unit, the second signal terminal is formed on the second terminal unit.

6. The cable assembly as recited in claim 1, wherein the case has a base portion and a mating portion extending forward from the base portion, the terminal module is disposed in the mating portion.

7. The cable assembly as recited in claim 6, further comprising a latching member and a pulling member connected with each other, the latching member and the pulling member are assembled to a top surface of the base portion of the case.

8. The cable assembly as recited in claim 1, wherein the case comprises a lower cover and an upper cover, the printed circuit board is positioned with the lower cover and the upper cover.

9. The cable assembly as recited in claim 8, wherein the upper cover defines a plurality of positioning posts, the lower cover defines a plurality of supporting posts, at least one positioning post has a free end passing through the printed circuit board and received into a receiving hole of the supporting post.

10. The cable assembly as recited in claim 1, further comprising a pair of screws assembled to the case to interlock with the upper cover and the lower cover.

11. A cable assembly for connecting with a complementary connector, comprising:

a metallic case having a receiving room;

a terminal module disposed in the receiving room, the terminal module having an insulative housing and a set of first terminals and a set of second terminals respectively formed on the insulative housing, each of first terminal and second terminal respectively having a mating section extending to a top surface of the housing, the mating section of each second terminal being in alignment with a mating section of a first terminal along a front to rear direction;

a cable extended into the receiving room and electrically connected with the terminal module.

12. The cable assembly as recited in claim 11, wherein the terminal module further defines a set of first terminals and a set of second terminals respectively formed on the insulative housing, each of first terminal and second terminal respectively has a mating section extending to a bottom surface of the housing, the mating section of each second terminal is in alignment with a mating section of a first terminal along a front to rear direction.

13. The cable assembly as recited in claim 12, wherein each set of first terminals comprise a plurality of first signal terminals and grounding terminals, and each set of second terminals comprises a plurality of second signal terminals, each mating section of first signal terminal is in alignment with a mating section of second signal terminal along a front to rear direction.

14. The cable assembly as recited in claim 12, wherein the terminal module comprises a first terminal unit and a pair of second terminal units assembled to the first terminal unit, two sets of first terminals are integrative formed on the first terminal unit, each set of second terminals are integrative formed on the second terminal unit.

15. The cable assembly as recited in claim 11, wherein the cable assembly further comprises a printed circuit board disposed between the terminal module and the cable and respectively electrically connected with the terminal module and the cable.

16. A cable connector assembly comprising:

a housing defining a receiving space;

a pair of essentially identical first terminal units back to back stacked with each other and commonly received in the receiving space, each of said first terminal units retaining a plurality of first contacts thereto, each of said first contacts defining a first front mating section and a first rear board mounting section;

a pair of essentially identical second terminal units back to back stacked with each other and commonly received in the receiving space and respectively confronting the corresponding pair of first terminal units in a vertical direction, each of said second terminal units retaining a plurality of second contacts thereto, each of said second contacts defining a second front mating section and a second rear board mounting section; wherein the first front mating sections are located in front of the second front mating sections in at least partially overlapping manner in a front-to-back direction perpendicular to said vertical direction, and during using the first front mating sections are stiff while the second front mating sections are resilient.

17. The cable connector assembly as claimed in claim 16, wherein the first front mating sections of the first contacts in the pair of first terminal units inward face toward each other in said vertical direction, and the second front mating sections of the second contacts in the pair of second terminal units inward face toward each other in said vertical direction, under condition that the first rear board mounting sections of the first contacts in the pair of first terminal units are essentially located between the second rear board mounting sections of the second contacts in the pair of second terminal units.

18. The cable connector assembly as claimed in claim 16, wherein the first front mating sections of the first contacts in the pair of first terminal units outward face away from each other in said vertical direction, and the second front mating sections of the second contacts in the pair of second terminal units outwardly face away from each other in said vertical direction, under condition that the second rear board mounting sections of the second contacts in the pair of second terminal units are essentially located between the first rear board mounting sections of the first contacts in the pair of first terminal units.

19. The cable connector assembly as claimed in claim 16, wherein the pair of first terminal units are directly intimately stacked with each other, and the pair of second terminal units are directly intimately stacked with each other.

20. The cable connector assembly as claimed in claim 16, wherein the interface between the pair of first terminal units is coplanar with that between the pair of second terminal units, and a printed circuit board, on which the first and second rear board mounting sections are mounted, defines a middle level, in a thickness direction thereof, is coplanar with said interface.

* * * * *